United States Patent [19]

Julseth

[11] Patent Number: 4,478,384

[45] Date of Patent: Oct. 23, 1984

[54] FASTENING DEVICE

[76] Inventor: Rolf Julseth, Bokfinkvn. 14, 1620 Gressvik, Norway

[21] Appl. No.: 386,701

[22] Filed: Jun. 9, 1982

[51] Int. Cl.[3] ..... A47F 7/14

[52] U.S. Cl. ..... 248/467

[58] Field of Search ..... 248/466, 467; 40/524, 40/124.1, 124.4; 24/DIG. 11, 304, 545, 546, 530, 679

[56] References Cited

U.S. PATENT DOCUMENTS

| | | | |
|---|---|---|---|
| 1,687,859 | 10/1928 | Fontaine | 24/DIG. 11 |
| 1,839,694 | 1/1932 | Nelson et al. | 248/467 |
| 2,045,672 | 6/1936 | Oliveri | 248/467 |
| 2,046,924 | 7/1936 | Pendergast | 40/594 |
| 2,634,529 | 4/1953 | Burdick | 40/594 |
| 3,128,072 | 4/1964 | Shibata | 248/467 |
| 3,350,045 | 10/1967 | Mayers | 248/467 |
| 3,833,452 | 9/1974 | Boucris | 40/594 |
| 3,836,419 | 9/1974 | Hamberger | 40/124.4 |
| 3,885,768 | 5/1975 | Frye | 248/467 |
| 3,894,684 | 7/1975 | Florey | 40/124.1 |
| 4,245,416 | 1/1981 | Maguire | 40/124.1 |
| 4,310,137 | 1/1982 | Frye | 248/467 |
| 4,372,519 | 2/1983 | Huntoon | 248/466 |
| 4,400,899 | 8/1983 | Martinez | 40/594 |
| 4,425,724 | 1/1984 | Scott | 24/67.9 |

*Primary Examiner*—William H. Schultz
*Assistant Examiner*—Ramon O. Ramirez
*Attorney, Agent, or Firm*—Howson and Howson

[57] ABSTRACT

A fastening device for securing paper sheets or cards to a rigid surface comprises a transparent resilient rectangular plastic sheet with an adhesive strip along its upper edge and a frictional pad near, but spaced from, its lower edge, the pad being at least as thick as the adhesive strip.

9 Claims, 2 Drawing Figures

FASTENING DEVICE

BRIEF SUMMARY OF THE INVENTION

This invention relates to fastening devices, and particularly to a fastening device for temporarily securing sheet material such as paper, cardboard or the like to a substantially rigid surface. The invention has particular utility in temporarily securing sheet material to glass surfaces such as store windows and automobile windows, but is more generally usable on other rigid surfaces such as building walls and the like. Examples of uses for the fastening device include the temporary securing of parking receipts on automobile windows, the temporary securing of advertising posters in shop windows, and the temporary securing of price information sheets to walls or display racks in shops. Heretofore, there has been no completely satisfactory way to display a parking receipt on an automobile. Typically, the parking receipt is secured underneath the windshield wiper, where it is exposed not only to weather, but also to unauthorized removal. Placing the parking receipt inside the automobile on its dashboard is not altogether satisfactory, because the parking receipt will then lie horizontally and will not be readily visible. It may also drop into the ventilating system of the automobile.

In shops, advertising posters are frequently secured to the windows by means of adhesive tape. This is inherently unsatisfactory because the tape becomes difficult to remove after the adhesive sets. It is difficult, therefore, to replace advertising posters which are taped to shop windows.

Heretofore, there has been no completely satisfactory way of displacing price information sheets in shops. Adhesive tape is sometimes used, but it is subject to the problems of removal mentioned above. Pins, thumbtacks and the like are used, but require special surfaces.

Of course, similar problems exist wherever it is necessary to display sheets of paper, cards, and similar articles.

The present invention provides a solution to the foregoing problems. The fastening device in accordance with the invention comprises a sheet of resilient plastic material normally having a substantially planar configuration and having a tendency to return to said planar configuration upon release of a distorting force. Adhesive means, comprising an area of adhesive material, are provided on one face of the resilient sheet for securing the sheet to a substantially rigid surface such as a pane of glass or a wall. A frictional pad is secured to the same face of the resilient sheet at a location spaced from the adhesive means. The frictional pad serves to clamp the sheet material to be held against the rigid surface under the action of the resilience of the resilient plastic sheet.

The sheet material to be held by the fastening device can be easily removed and replaced. Therefore, the device is especially suited for such uses as displaying parking receipts and holding advertising posters or price information sheets.

Another desirable feature of the invention resides in the use of a frictional pad which is at least as thick as the thickness of the adhesive means. This insures that the device will be capable of holding even the thinnest sheets of paper. To insure a firm grip on paper and other materials, the pad is preferably made from a compressible foam plastic material such as foam rubber, as such materials have a frictional characteristic ideal for the purpose of holding paper and similar materials, and are also capable of holding slippery materials such as coated paper or cardboard and plastic sheets.

In accordance with another aspect of the invention, the resilient sheet is a transparent material. Transparency makes the fastening device particularly suitable for fastening parking receipts to the inside of automobile windshields, as it minimizes interference with the driver's visibility, and thus can remain on the windshield at all times. Transparency is, of course, also desirable in some other applications of the device.

Another significant refinement of the invention is the formation of the adhesive means in such a way that its lower edge is straight. When the straight lower edge of the adhesive means is positioned horizontally, it serves as a stop for the sheet material to be held. Assuming the sheet material is rectangular, the straight lower edge of the adhesive means automatically positions the sheet being inserted so that its upper and lower edges are horizontal and its side edges are vertical.

The frictional pad is preferably spaced from the lower edge of the sheet of resilient plastic material. This feature is particularly useful when comparatively stiff cards and similar materials are to be held by the fastening device, because it enables such cards and materials to be inserted with one hand.

The objects of this invention include the provision of a fastening device for sheets of paper, cards and similar materials which is simple, easy to use and reliable; to provide a fastening device capable of a wide variety of uses; to provide a fastening device which impedes visibility minimally; to provide a fastening device which is capable of holding a wide variety of sheet materials; and to provide a fastening device which can remain in place substantially permanently while allowing sheets to be removed and replaced readily. A further object of the invention is to provide a basic design for a fastening device which can be modified to meet various demands without the need for keeping a large variety of parts in stock.

The manner and means by which the foregoing objects are achieved and various other objects of the invention will be more apparent from the following detailed description when read in conjunction with the drawings.

DETAILED DESCRIPTION

Figure 1:
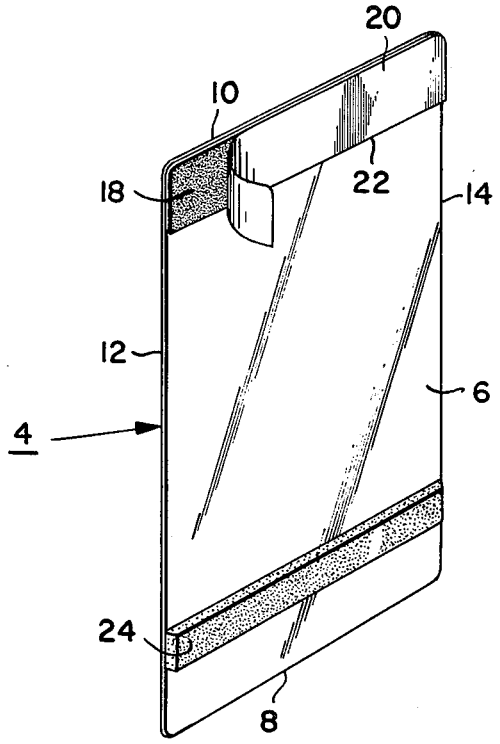
FIG. 1 is an oblique perspective view of a fastening device in accordance with the invention.

FIG. 1 shows a typical fastening device 4 comprising a generally rectangular plastic sheet 6 having a lower edge 8, an upper edge 10, and side edges 12 and 14. The plastic sheet can be made from any of a wide variety of polymers. However, the formulation which is used should be such that the polymer, when formed into a sheet, exhibits a high degree of resiliency, i.e., a tendency to return to its normal planar configuration upon release of a distorting force. Materials such as polyethylene, polypropylene, polystyrene, acrylic resins such as methyl methacrylate and many others can be used in making sheet 6.

The dimensions of sheet 6 can also vary considerably. Typically, the sheet is 1 mm. in thickness, side edges 4 and 6 are 10 mm. in length, while top and bottom edges 10 and 8 are 5 mm. in length.

For some applications, especially where the fastener is to be used to display printed sheets on glass windows, the formulation of the plastic sheet should be chosen for transparency.

On one face of sheet 6, extending along its upper edge 10 from side edge 12 to side edge 14, is an elongated strip 18 of adhesive material, preferably of the "self-adhering" type so that it will adhere to practically any surface against which it is placed. A peelable protective sheet 20 is provided over adhesive strip 18. This protective sheet is peeled away immediately before the fastener is to be attached to a surface.

The lower edge 22 of adhesive strip 18 is preferably straight and parallel to upper and lower edges 10 and 8 of sheet 6. The fastening device is preferably mounted on a surface with edge 22 of the adhesive strip horizontal. With the device mounted in this manner, a card, sheet of paper, or other sheet-like article can be inserted between the fastening device and the surface on which it is mounted and pushed all the way up against edge 22 of adhesive strip 18. When this is done, edge 22 serves to align the upper edge of the card or like article horizontally.

Near lower edge 8 of sheet 6, an elongated pad 24 is provided. This pad extends horizontally from edge 12 to edge 14, and is spaced vertically below edge 22 of adhesive strip 18. Pad 24 is also preferably spaced above lower edge 8 of sheet 6. This spacing should be at least approximately equal to the normal thickness of pad 24, i.e., the thickness assumed by pad 24 when the fastening device is adhesively secured to a rigid planar surface with no article present between the fastening device and the surface. The spacing between pad 24 and edge 8 can, of course, be several times the normal thickness of strip 24, the typical spacing being at least approximately three times the normal thickness of the strip.

Pad 24 extends parallel to edge 8, and serves as a frictional pad for clamping sheet material to be held against the rigid surface to which the fastening device is adhesively secured by adhesive strip 18.

Pad 24, when uncompressed, is preferably at least as thick as adhesive strip 18, and it may be substantially thicker than adhesive strip 18 without impairing the function of the device. Pad 24 is preferably a resilient compressible foam material such as foam rubber or the like. Foam rubber, especially when formed with very fine cells, is an ideal material since it exhibits good frictional characteristics for holding paper, cardboard and similar materials, including comparatively slippery materials such as coated paper and coated cardboard.

Figure 2:
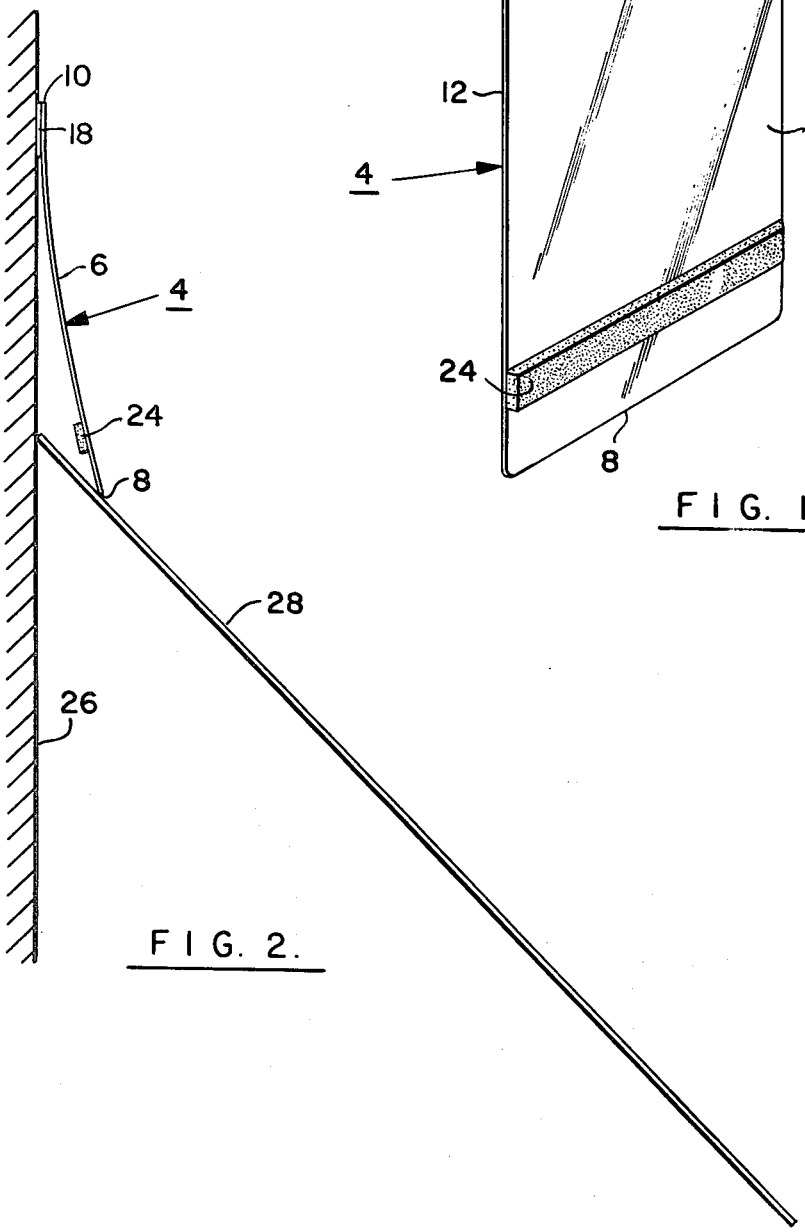
FIG. 2 is a vertical section taken through a rigid mounting surface, showing a fastening device secured thereto and illustrating the manner in which a comparatively stiff card can be inserted into the fastening device with one hand.

FIG. 2 shows fastening device 4 secured by adhesive strip 18 to a rigid vertical surface 26, and shows a sheet 28 of cardboard being inserted between the fastening device and surface 26. With frictional pad 24 spaced sufficiently above lower edge 8 of sheet 6, any relatively stiff sheet 28, upon engaging edge 8 of the fastener, can be made to move edge 8 away from surface 26, thus allowing sheet 28 to be inserted more fully. Sheet 28 can be inserted using only one hand. Pad 24 should be sufficiently thick that the opening provided between lower edge 8 of sheet 6 and surface 26 is wide enough to receive the end of sheet 28, and should be spaced above lower edge 8 by a distance at least approximately equal to the normal thickness of pad 24, in order to allow sheet 28 to serve as a lever to move edge 8 away from surface 26.

By changing the dimensions of the fastening device, or by changing the material from which sheet 4 is made, or by changing its thickness, or by changing the distance between the lower edge of the adhesive strip and the friction pad, or by changing the type of material (e.g. the cell size) in the foam pad, the fastening device can be made to meet different demands. For example, if sheet 4 is made thick, and of a stiff but elastic material, and the distance between adhesive strip 18 and pad 24 is made relatively small, the fastening device will be capable of holding comparatively heavy articles, such as large cardboard signs.

Modifications can also be made in various other aspects of the fastening device, for example in the shape and configuration of the plastic sheet and in the positions of the adhesive and frictional strips. In manufacture of this fastening device, a wide range of operating characteristics can be provided without having to keep in stock a large number of different sizes of plastic sheet and a large number of different types of frictional strip material. The desired characteristics can usually be achieved simply by choosing from a relatively small number of sheet types and from a small number of frictional strip materials. Various other modifications can be made without departing from the scope of the invention as defined in the following claims.

I claim:

1. A fastening device for temporarily securing sheet material such as paper, cardboard or the like to a substantially rigid surface, comprising:

a sheet of resilient plastic material normally having a substantially planar configuration and having a tendency to return to said planar configuration upon release of a distorting force, adhesive means, comprising an area of adhesive material on one face of said sheet, for securing said sheet to a substantially rigid surface, means, comprising a frictional pad secured to said face at a location spaced from said adhesive means, for clamping the sheet material to be held against said substantially rigid surface under the action of the resilience of said sheet of resilient plastic material.

2. A fastening device according to claim 1 in which the uncompressed depth of the frictional pad measured in a direction perpendicular to the sheet of resilient plastic material is at least as great as the depth of the adhesive means measured in the same direction.

3. A fastening device according to claim 1 or 2 in which the frictional pad is a layer of resilient compressible foam material.

4. A fastening device according to claim 1 in which the sheet of resilient plastic material is transparent.

5. A fastening device according to claim 1 in which the adhesive means is in the form of an elongated strip of adhesive material and said frictional pad is in the form of an elongated strip extending in a direction parallel to the direction of elongation of the strip of adhesive material.

6. A fastening device according to claim 1 in which the edge of the adhesive means nearest the frictional pad is substantially straight.

7. A fastening device according to claim 1 in which the frictional pad is located between the adhesive means and an edge of the sheet of resilient plastic material and is spaced from said edge.

8. A fastening device according to claim 1 in which the sheet of resilient plastic material is substantially rectangular and in which the frictional pad is elongated, extends parallel to an edge of said sheet and is spaced from said edge.

9. A fastening device according to claim 1 in which said sheet of resilient plastic material is transparent and substantially rectangular, said adhesive means is in the form of an elongated strip of adhesive material extending parallel to one edge of said sheet and having one of its long edges substantially aligned with said one edge of the sheet and having the other of its long edges extending in substantially parallel relationship to the edge of said sheet opposite said one edge, in which the frictional pad is an elongated layer of compressible foam material having an uncompressed depth, measured perpendicular to the sheet of resilient plastic, at least as great as the depth of the adhesive means measured in the same direction, and in which the long dimension of the frictional pad extends parallel to said edge of the sheet opposite said one edge and said pad is spaced from said edge opposite said one edge and from said adhesive means.

* * * * *